United States Patent [19]

Betschler

[11] 4,447,298

[45] May 8, 1984

[54] METHOD OF OPERATING AN ELECTROPLATING SYSTEM

[75] Inventor: Joachim Betschler, Eckental, Fed. Rep. of Germany

[73] Assignee: Holl & CIE GmbH, Nürnberg, Fed. Rep. of Germany

[21] Appl. No.: 304,373

[22] Filed: Sep. 22, 1981

[30] Foreign Application Priority Data

Sep. 30, 1980 [DE] Fed. Rep. of Germany ..... 3036937

[51] Int. Cl.[3] ..... C25D 5/00; C25D 17/12

[52] U.S. Cl. ..... 204/23; 204/285

[58] Field of Search ..... 204/23, 285; 29/148.4 B

[56] References Cited

U.S. PATENT DOCUMENTS

| | | | |
|---|---|---|---|
| 1,204,127 | 11/1916 | Canda | 29/148.4 B |
| 1,765,706 | 6/1930 | Stewart | 204/285 |
| 1,868,052 | 7/1932 | Dubpernell | 204/285 |
| 2,313,876 | 3/1943 | Jelinek | 29/148.4 B |
| 2,614,317 | 10/1952 | Deussen | 29/148.4 B |
| 3,300,396 | 1/1967 | Walker | 204/49 |

FOREIGN PATENT DOCUMENTS

| | | | |
|---|---|---|---|
| 217938 | 6/1908 | Fed. Rep. of Germany | 204/285 |
| 357977 | 9/1931 | United Kingdom | 204/285 |

*Primary Examiner*—T. M. Tufariello

*Attorney, Agent, or Firm*—Karl F. Ross; Herbert Dubno

[57] ABSTRACT

Anode bodies for a galvanic plating bath, e.g. for electrodeposition of copper, are spheres which can be received in an anode holder in the bath and have advantages over irregular and other anode shapes deriving from the fact that the metal is solubilized uniformly substantially over the entire surface area of the anode bodies and a uniform reproducible contact is made between them. The invention also comprehends a method of making such bodies by pressing cylindrical blanks, e.g. wire sections, to spherical shape, and a method of operating an electroplating bath which involves the use of such anode bodies.

2 Claims, 3 Drawing Figures

METHOD OF OPERATING AN ELECTROPLATING SYSTEM

FIELD OF THE INVENTION

My present invention relates to an improved method of operating a galvanic plating system as well as with a method of making improved anode bodies for use in such systems.

BACKGROUND OF THE INVENTION

In the galvanic deposition or electroplating of cathodes with metal from an anode, the anode and the cathode are immersed in an electrolyte forming an electroplating bath and connected to a source of electric current, usually direct current, polsed so that the metal of the anode solubilizes in the bath and by ionic transport ultimately is deposited upon the cathode.

In high capacity cyanide baths for copper plating, for example, the anodes are generally solid bodies supported by angles and juxtaposed with the cathode. For acid baths solid anodes of phosphor copper may be used.

Electroplating of copper can be utilized to deposit protective coatings or conductive or decorative coatings, to form shapes of copper metal which are difficult to fabricate in other ways, and for a variety of purposes. For example, the coating may have to be applied to intricate shapes, e.g. to printing drums or to printed circuit boards or to other electronic and electrical devices.

In this case, to ensure a uniform deposition of the plated metal upon the cathode, auxiliary electrodes may be provided which can consist of electrode holders, e.g. titanium baskets, containing pieces of the anode metal, i.e. anode bodies. Such electrodes may also be used as the principal electrodes in many cases. With such auxiliary or main electrodes, it is important that the anode metal be solubilized substantially uniformly from the anode bodies, the uniformity of solubilization being related to the uniformity of plating and the operating effectiveness of the bath. This has been found to be particularly important for precision electronic equipment and high-cost items.

The current technique involves the use of copper granules, electrolytic copper scrap and like materials as anode bodies.

However, with the existing systems, significant difficulties have been encountered. For example, with anode bodies of the irregular shapes hitherto employed, the filling of the baskets to a fixed or constant packing density has been difficult so that the quantity of anode metal per unit volume in the basket, for example, fluctuated during the course of a plating process.

The contact surfaces between the granules varied significantly and hence the available surface, i.e. the surface at which solubilization of the metal occurred, fluctuated substantially.

Attempts were made to overcome these disadvantages.

For example, it has been proposed to use wire sections which have the advantage that they are all of a uniform character if of the same diameter and length. However, the aforementioned problems cast a shadow upon this technique and, in addition, the wire sections tended to bridge across the filling cross section and prevent further packing of the baskets.

In general, therefore, the use of baskets with anode bodies heretofore has been plagued by a variety of problems which have necessitated almost daily removal of the baskets and hence interruption of the plating operation for servicing. This of course cuts production and wastes energy since the baths generally have to be reheated. The downtime can be several hours in each case.

OBJECTS OF THE INVENTION

It is, therefore, the principal object of the present invention to provide using an improved method of operating an electroplating bath anode bodies, especially for the electrodeposition of copper, which can be utilized in baskets, e.g. anode holders for auxiliary plating anodes, whereby the disadvantages enumerated above can be obviated.

It is also an object of the invention to provide a method of making the improved anodes.

SUMMARY OF THE INVENTION

It has now been discovered, quite surprisingly, that the difficulties heretofore encountered with the various anode bodies heretofore employed for the purposes described can be obviated by substituting for these anode bodies in anode holders or baskets in electrodeposition or galvanic plating baths, anode bodies which have a spheric configuration and by utilizing anode bodies of identical diameter as the anode packing for the anode holders or baskets.

The ball-shaped packing bodies of this invention have the same curvature on all sides and at all points along the surface so that contact surfaces between the bodies are always points and the nature of the contact between the adjacent bodies of the packing is always identical. The bodies roll with ease and uniformity, greatly facilitating the charging of the baskets with them and a uniform packing of the baskets even during the electroplating process. Identical spherical anode bodies have identical solubilization rates of the metal from the surfaces of the bodies and for bodies of a given diameter and a basket of a given volume and shape, the packing density is always the same.

Furthermore, when the diameters of the bodies are greater than half the diameter of the elongated compartment of the basket in which the bodies are received, but less than the diameter of this compartment, the bodies have an orientation which is reproducible, even with refilling of the basket during operation so that the plating operation need not be interrupted and downtime can be eliminated.

Preferably the spheroidal anode bodies have diameters of 5 to 30 mm, preferably 10 to 15 mm.

Under these conditions, the bodies tend to roll into the baskets without bridging or blocking, forming a single body at each level in the basket so that layering and non-uniform packing is avoided.

I have found that such bodies can be made most effectively by cutting segments of a predetermined constant length from a wire of the anode metal and pressing the resulting cylindrical blanks or sections to the spherical configuration. The wires can be made by any conventional technique, e.g. rolling, casting or pressing. The wire or rod can be composed of pure or alloyed metal as is required and the preferred wire diameter can be empirically determined based upon the pressing conditions. I have found, however, that it should preferably be about 20% less than the diameters of the balls to be made. The press can be located downstream of a rod-cutting installation so that the cutting, pressing and ejection of the pressed balls can be effected continuously. In fact, the balls can be made completely automatically.

BRIEF DESCRIPTION OF THE DRAWING

The above and other objects, features and advantages of the present invention will become more readily apparent from the following description, reference being made to the accompanying drawing in whch.

SPECIFIC DESCRIPTION

Figure 1:
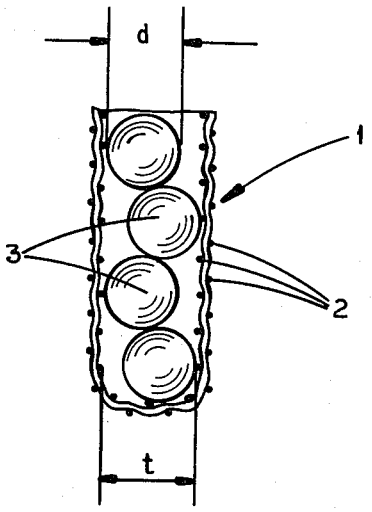
FIG. 1 is an axial section of a portion of an anode holder containing the anode bodies of the present invention.

FIG. 1 of the drawing shows an anode basket 1 composed of titanium wire mesh 2 and filled with the anode balls 3 which are of spherical configuration and have diameters d which are slightly less than the diameter or width t of the basket compartment in which they are received. The stack is thus of the single-member layering type and no matter how the balls are introduced into the basket, the nature of the contact between the balls will remain the same. This also applied during leveling, and blocking or bridging is always precluded.

Figure 3:
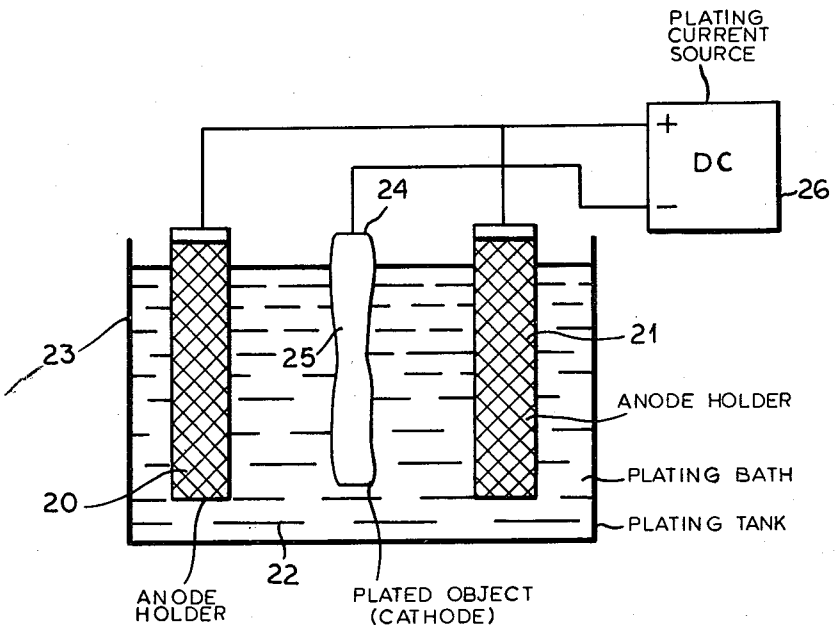
FIG. 3 is a diagrammatic illustration of an electrolytic plating bath operated in accordance with the method of this invention.
Figure 2:
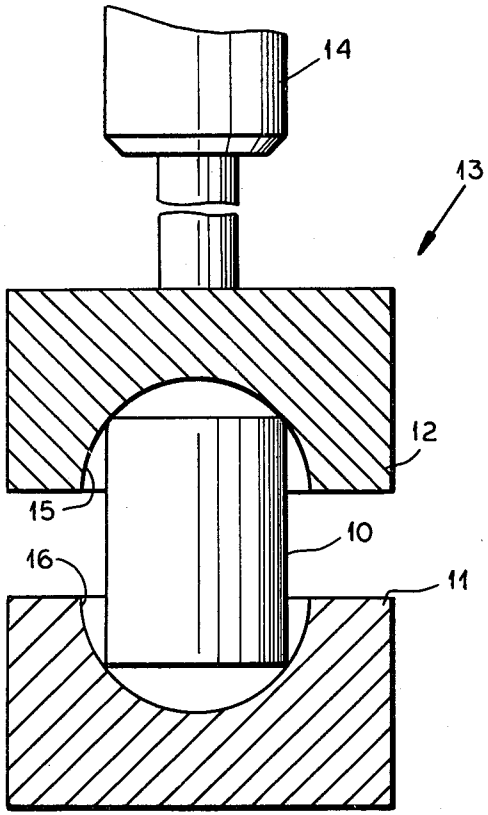
FIG. 2 is a diagrammatic section through a press for making such anode bodies.

As can be seen from FIG. 3, wire sections 10 can be cut from a continuous length of cylindrical-cross-section wire so that these blanks can be inserted between the dies 11 and 12 of a press 13 which can have a hydraulic cylinder 14 for applying sufficient pressure to press the blank 10 into the cavities 15 and 16 defining a sphere. The means for automatically cutting the wire, feeding the press and ejecting the anode balls have not been illustrated.

Ball-shaped anode holders of the type described are shown at 20 and 21 to be immersed in an electroplating bath 22 of a plating tank 23 and to be juxtaposed with the cathode 24 which is plated upon its surface 25. The plating current source 26 is connected to the anodes and cathodes.

I claim:

1. A method of operating an electroplating system which comprises the steps of:

(a) cutting successive sections from a cylindrical wire of a metal to be electrodeposited to form cylindrical blanks;

(b) pressing said blanks to form therefrom individual anode bodies of said metal having a diameter of 5 to 30 mm;

(c) introducing anode bodies made in step (b) and all of the same diameter into an anode basket, the bodies which are introduced into said basket being selected to have a diameter greater than half the diameter of said basket but less than the diameter of said basket;

(d) immersing said basket in an electroplating bath in juxtaposition with a cathode upon which said metal is to be plated; and (e) electrodepositing said metal on said cathode from said bath.

2. The method defined in claim 1 wherein said metal is copper.

* * * * *